US007703180B2

(12) United States Patent
Raccosta

(10) Patent No.: US 7,703,180 B2
(45) Date of Patent: Apr. 27, 2010

(54) PRESSURE BOTTON

(76) Inventor: Gaetano Raccosta, Via Petrarca, 5, 23807 Merate (Lecco) (IT)

( * ) Notice: Subject to any disclaimer, the term of this patent is extended or adjusted under 35 U.S.C. 154(b) by 0 days.

(21) Appl. No.: 11/100,091

(22) Filed: Apr. 6, 2005

(65) Prior Publication Data

US 2005/0223527 A1 Oct. 13, 2005

(30) Foreign Application Priority Data

Apr. 8, 2004 (IT) ..... MI04A0706

(51) Int. Cl.
*A44B 1/42* (2006.01)

(52) U.S. Cl. ..... 24/94; 24/95; 24/96

(58) Field of Classification Search ..... 24/94–96, 24/101 R, 101 B, 114.4, 114.5, 114.12, 104, 24/106–108
See application file for complete search history.

(56) References Cited

U.S. PATENT DOCUMENTS

| | | | | | |
|---|---|---|---|---|---|
| 226,722 | A * | 4/1880 | D'Aubigne | 24/95 |
| 494,104 | A * | 3/1893 | Kraetzer | 24/692 |
| 834,035 | A * | 10/1906 | Washburne | 24/671 |
| 1,053,260 | A * | 2/1913 | Ford | 24/94 |
| 1,899,680 | A * | 2/1933 | Ford | 24/95 |
| 1,985,758 | A * | 12/1934 | Barratt | 24/95 |
| 2,242,352 | A * | 5/1941 | Fenton | 24/681 |
| 2,312,441 | A * | 3/1943 | Reiter | 24/674 |
| 2,312,443 | A * | 3/1943 | Reiter | 24/680 |
| 2,683,908 | A * | 7/1954 | Carpinella | 24/108 |
| 2,724,162 | A * | 11/1955 | Fenton | 24/681 |
| 2,771,653 | A * | 11/1956 | Carpinella | 24/681 |
| 3,002,246 | A * | 10/1961 | Carpinella et al. | 24/689 |
| 3,010,169 | A * | 11/1961 | Carpinella | 24/107 |
| 4,627,134 | A * | 12/1986 | Takata | 24/687 |
| 4,641,401 | A * | 2/1987 | Hasegawa | 24/681 |
| 4,847,959 | A * | 7/1989 | Shimada et al. | 24/671 |
| 4,890,364 | A * | 1/1990 | Tanaka et al. | 24/673 |
| 5,308,671 | A * | 5/1994 | Wells | 428/99 |
| 2006/0021198 | A1 * | 2/2006 | Raccosta | 24/104 |

* cited by examiner

*Primary Examiner*—Jack W. Lavinder
(74) *Attorney, Agent, or Firm*—Hedman & Costigan, P.C.; James V. Costigan

(57) ABSTRACT

A pressure button, of the type comprising a male portion and a female portion, to be applied on flaps to be connected, the female portion comprising a fixing element for fixing an active female element, the latter including a plurality of resilient tabs which are mutually arranged with a ring arrangement about a housing recess for housing a projecting part of the male portion. The active female element of the button comprises an annular body to which a clamp element including a plurality of points projecting outside of the active female element is affixed.

In particular, the assembling means for assembling the female portion are so arranged as to operate at a separated and moved away position from the resilient tabs, thereby the assembling of the female portion, for applying the latter on a respective material flap, can be performed without modifying the mutual shape and/or arrangement of the resilient tabs, thereby preserving the rated clamping pressure of the button.

3 Claims, 7 Drawing Sheets

PRESSURE BOTTON

BACKGROUND OF THE INVENTION

The present invention relates to a novel improved pressure button.

More specifically, the field of the invention is that of the pressure buttons which are conventionally used for mutually clamping two parts or flaps, for example of a cloth or other article in general, made of a fabric, paper, plastic material, in sheet form, or other small weight material.

As is known, pressure buttons usually comprise a male portion to be clamped on a first flap to be connected, and a female portion made rigid with the other flap.

Each button portion is, in turn, constituted by an active element, forming the male/female component of the connection, and a clamping element for clamping the active element on the fabric, paper or the like material flap. In particular, the invention is particularly related to pressure buttons in which the active female element comprises a disc-like body including a plurality of resilient tabs or tongues which are arranged with a ring-like or loop arrangement, thereby providing a desired engagement with the active male element.

In such an application, it is known to clamp the active female element to the fabric flap by a ring including projecting points, said ring being formed integrally with the related clamping element. Thus, the anchoring of the pressure button female portion to the fabric flap is conventionally performed by introducing the clamping element points into suitable recesses or up-turned portions formed on the active female element.

Such an introduction or engagement is moreover performed in a forced manner, thereby deforming the points directly inside the active female element, so as to anchor the corresponding part on the fabric flap.

Such a connection, however, is affected by the drawback that even a small mechanical stress on the resilient tabs of the active female element, greatly negatively affect the mechanical strength of the connection between the male and female portions of the pressure button.

Thus, the engagement of the clamping element points inside the up-turned portions formed at the active female element, frequently causes a deformation of said resilient tabs or tongues, thereby the latter will not be able of providing the desired snap engagement operation on the active male element.

Consequently, conventional pressure buttons are subjected to undesired openings, caused by small efforts, or, vice versa, can require an excessively great effort to provide the opening of said pressure buttons.

SUMMARY OF THE INVENTION

Accordingly, the main object of the present invention is to provide a novel improved pressure button, of the type including an active female element comprising a plurality of resilient tabs arranged with a ring-like arrangement, allowing to properly anchor or connect the active female element on a fabric flap, without negatively affecting the rated connection pressure of the button, as generated by the coupling of said tabs on the active male element.

The above object, as well as yet other objects, are achieved by the pressure button according to claim 1.

Preferred embodiments of the invention are defined in the remaining claims.

With respect to prior pressure buttons, the inventive pressure button provides the advantages of transferring to the clamping element, and, accordingly, not to the active female element, the effort of the points of the clamping ring element.

Thus, the resilient tabs of the female element are not deformed as the female portion is applied to the fabric flap, thereby providing a desired mechanical engagement between the active parts of the pressure buttons.

Advantageously, moreover, in an embodiment of the inventive pressure button including a bell type of clamping element, the absence of coupling points between the clamping element and active female element will prevent the resilient tabs of the latter from being deformed.

BRIEF DESCRIPTION OF THE DRAWINGS

The above mentioned objects, advantages and features will become more apparent hereinafter from the following detailed disclosure of some preferred embodiments of the inventive pressure button, which are illustrated, by way of a non limitative example, in the accompanying drawings, where.

DESCRIPTION OF THE PREFERRED EMBODIMENTS

Figure 1:
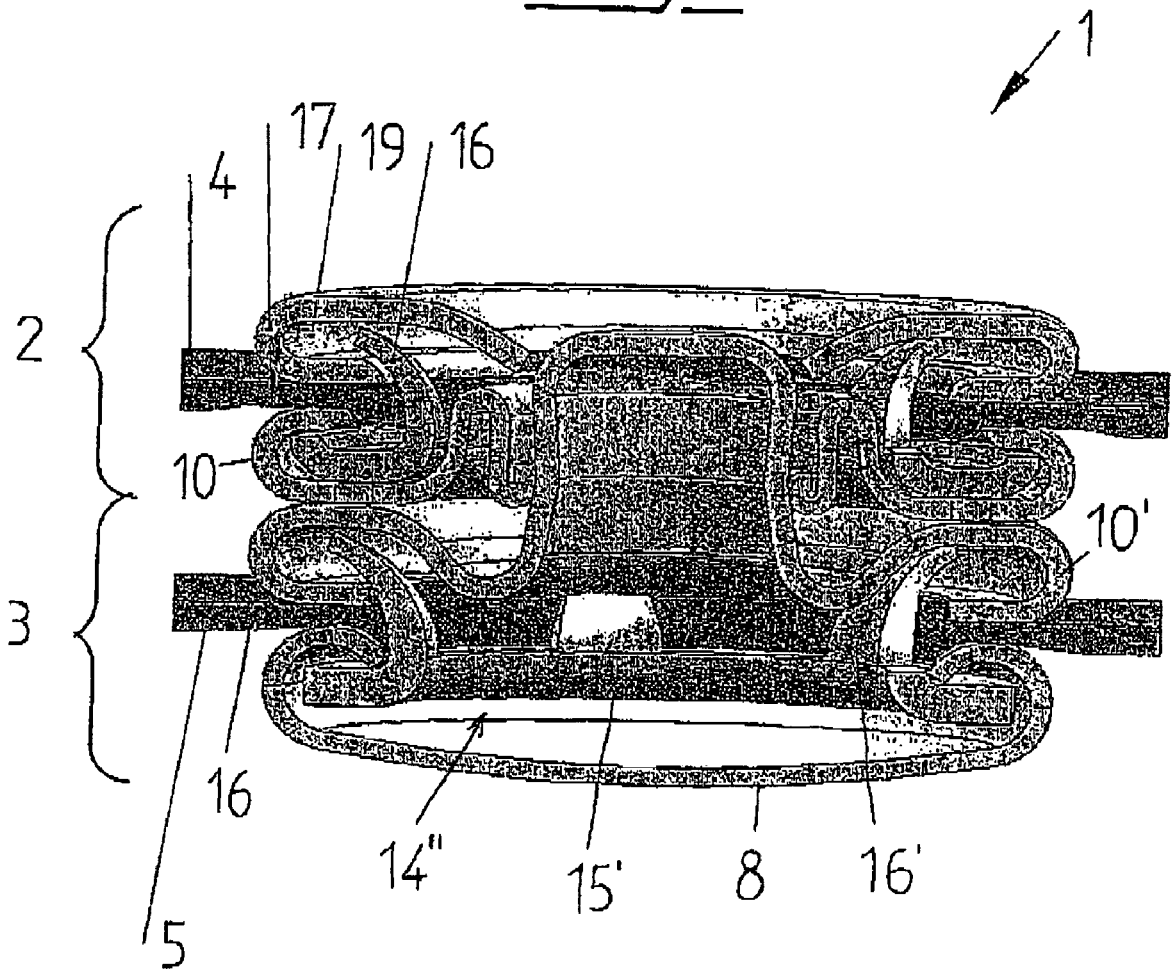
FIG. 1 is a cross-sectional view illustrating a first embodiment of a pressure button according to the present invention.

The pressure button according to the invention has been generally indicated by the reference number 1 in FIG. 1. It comprises a female portion 2, clamped on a first flap 4, for example of a fabric material, and a male portion 3, clamped on the other fabric flap 5.

In turn, the female portion 2 comprises a clamping element 6 and an active female element 7, whereas said male portion 3 comprises a clamping element 14' and an active male element 9.

More specifically, the active female element 7 comprises a metal active female element annular body 10 with an edge inward folded which is folded toward the inner part of the active female element 7 thereby forming, at a recess 11 designed for receiving a projecting central part or stud 12 of the active male element 9, a plurality of resilient bottom tabs 13 which are mutually arranged with a ring or loop-like arrangement.

In the folded edge of said active female element annular body 10 is also clamped a clamp or gripping element 14, in turn comprising an annular base or bottom 15 locked inside said body 10 and a plurality of points 16 formed integrally with said bottom 15 and projecting outside of the active female element 7.

The clamping element 6 for clamping said active female element 7 and, accordingly, the overall female part or portion 2 of the pressure button, to the fabric flap 4, comprises a cap 17 having edges 18 folded toward the inside of the pressure button, thereby defining a peripheral groove 19 in which are locked, by deforming, the projecting points 16 of the active female element 7 (FIG. 1).

As shown in FIGS. 1,2,3,5 and 6 the active male element 9 comprises an active male element annular body 10' having an inward folded edge and integral with said central stud 12, in said inward folded edge of said active male element annular body being clamped an active male element clamp or gripping element 14' in turn comprising an annular base or bottom 15' locked inside said body 10' and having a plurality of integral points 26' to be bent for locking said gripping element 14 in the inward folded edge of the body 10', said gripping element being clamped in a clamping cap 8 for clamping the male element to the fabric flap 5.

In applying the female portion 2 of the pressure button 1 on the fabric flap 4, the assembling of the active female element 7 on the respective clamping element 6, are performed by engaging the points 16 inside the groove 19 of said element 6, does not generate any deformations or stresses on the resilient tabs 13 of the active female element 10, thereby providing the desired mechanical connection strength of the parts 9 and 7 of the pressure button 1.

Figure 3:
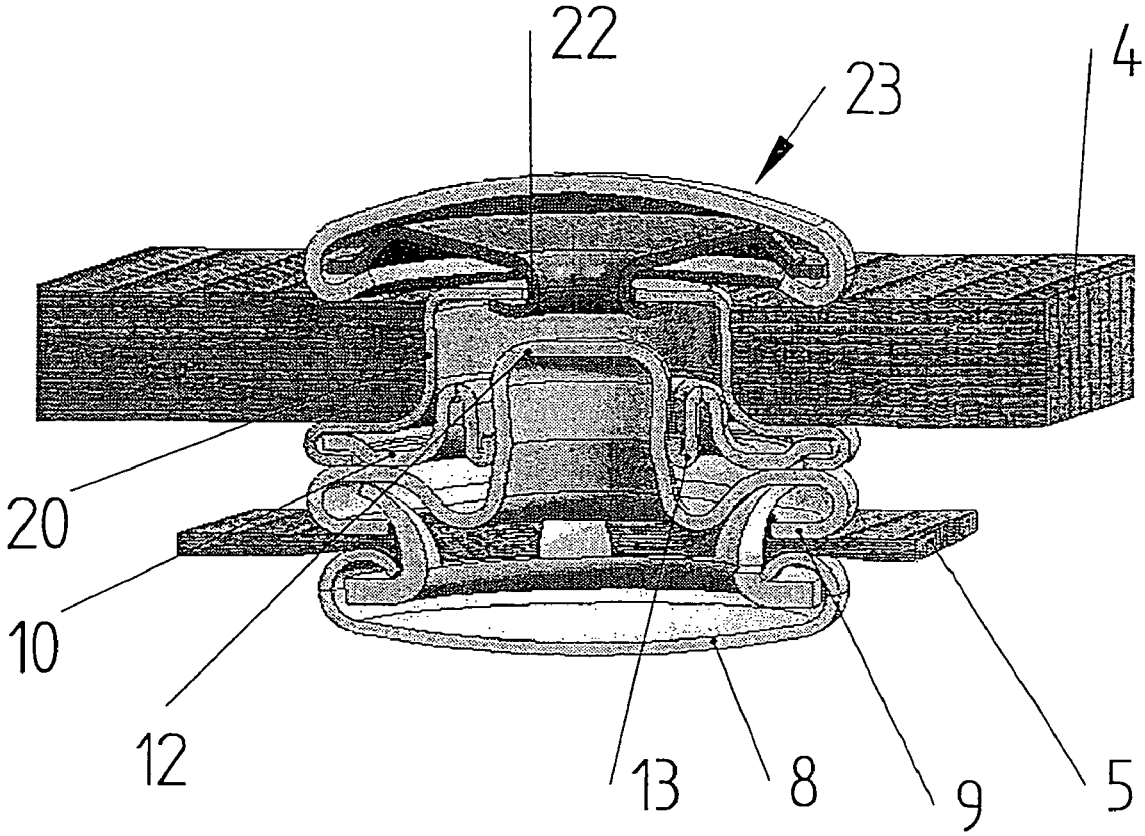
FIG. 3 is a further cross-sectional view illustrating a first modified embodiment of the pressure button according to the present invention.
Figure 4:
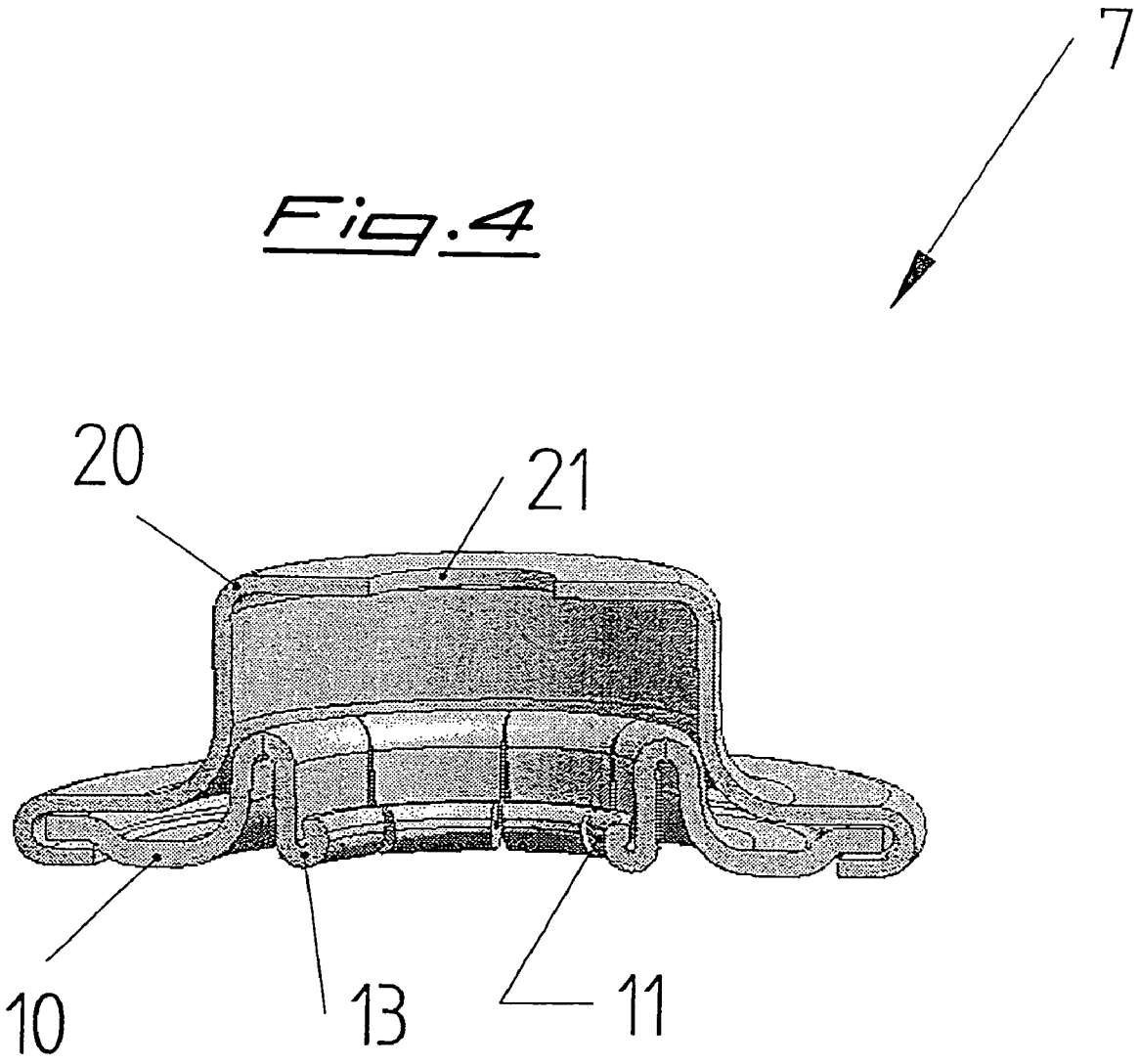
FIG. 4 illustrates a detail of the active female element of the pressure button shown in FIG. 3.

According to a modified embodiment shown in FIGS. 3 and 4, the pressure button according to the present invention also comprises a male portion 2 formed by a clamping element 8 and an active male element 9, and a female portion comprising a plurality of resilient tabs 13 which are arranged with a ring-like arrangement about a recess 11 for receiving a projecting part 12 of the active male element.

In the shown modified embodiment, on the annular body 10 of the active female element 7 a bell element 20 is clamped, said bell element 20 including an axial central hole 21 for engaging therein a stem 22 of a clamping head 23 of the active female element 7 on the fabric flap 4.

Even in this case, accordingly, the application of the female portion of the pressure button on the fabric flap 4, made through the coupling head 23, is performed without deforming the resilient tabs or tongues 13 of the active female element 7.

Figure 5:
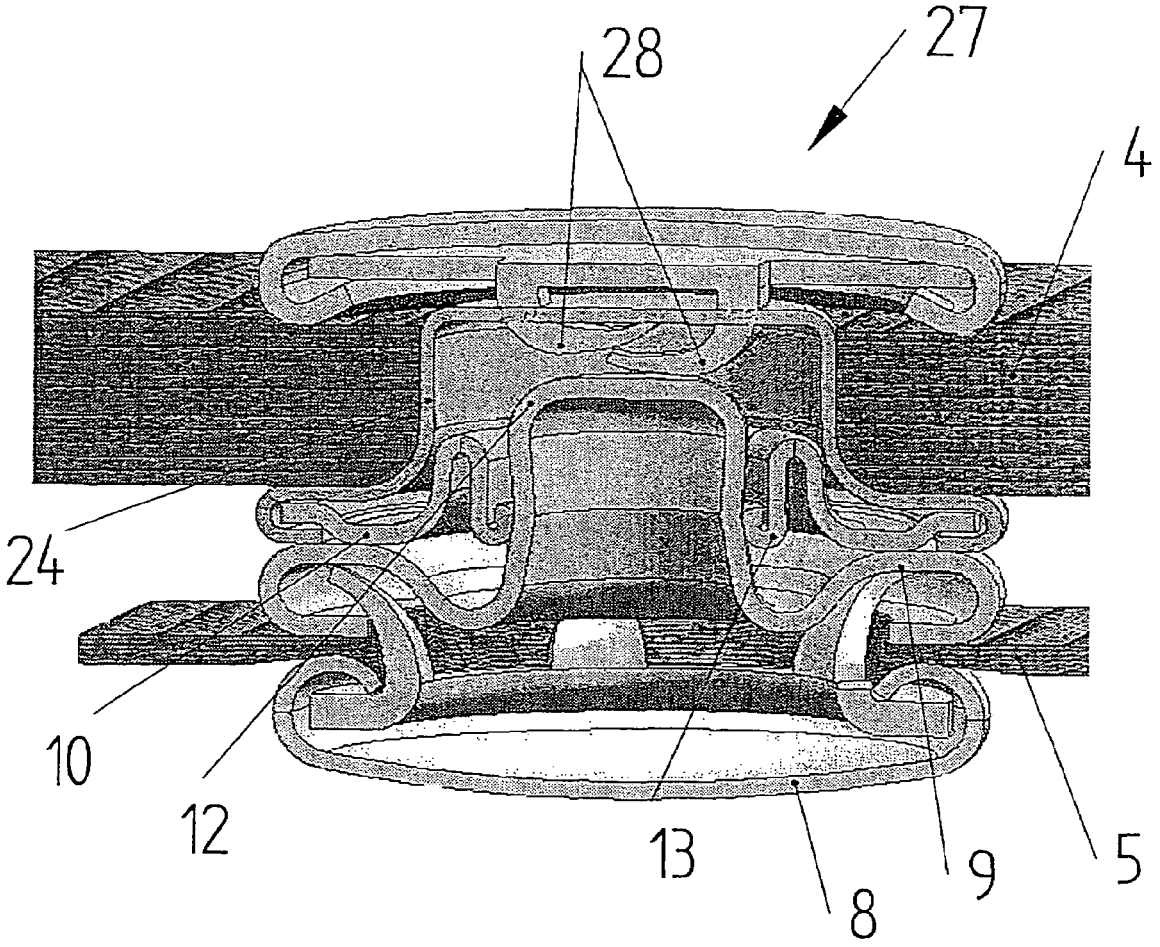
FIGS. 5 and 6 are further cross-sectional views illustrating two further modified embodiments of the pressure button according to the invention.
Figure 6:
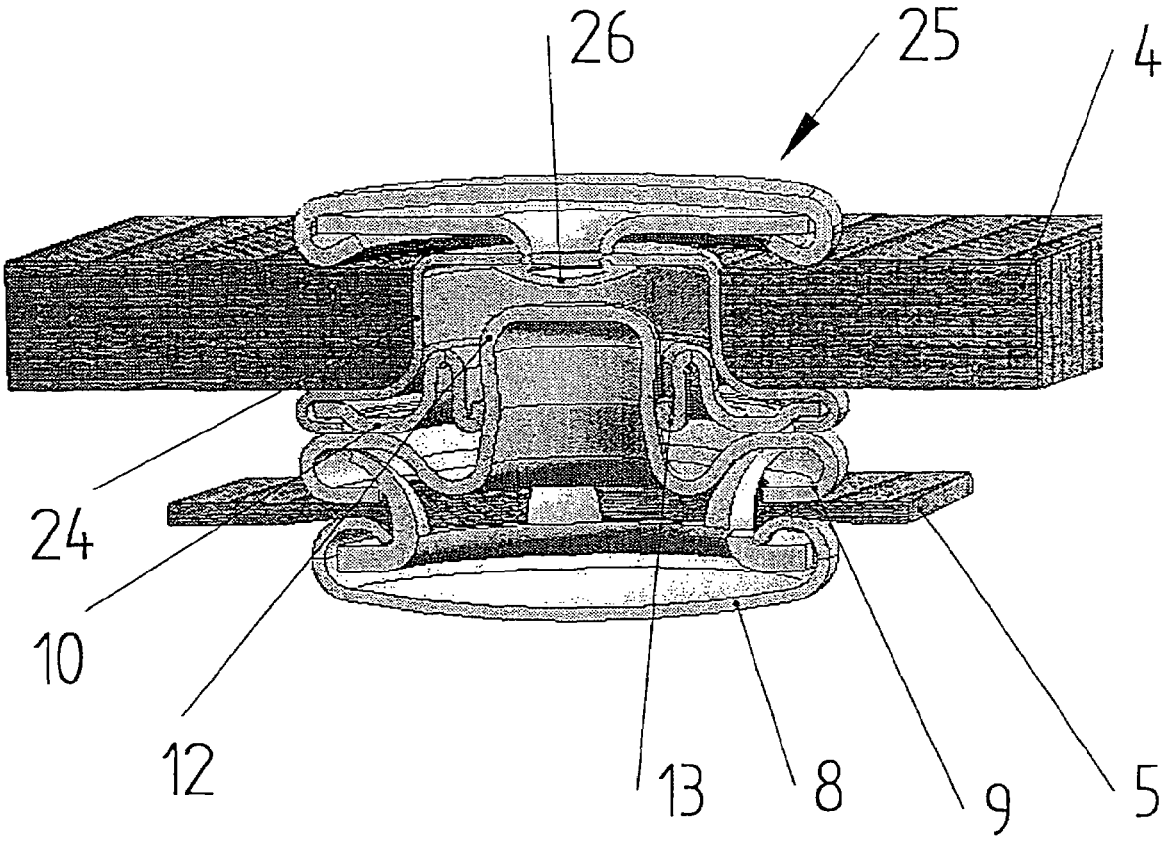
Figure 7:
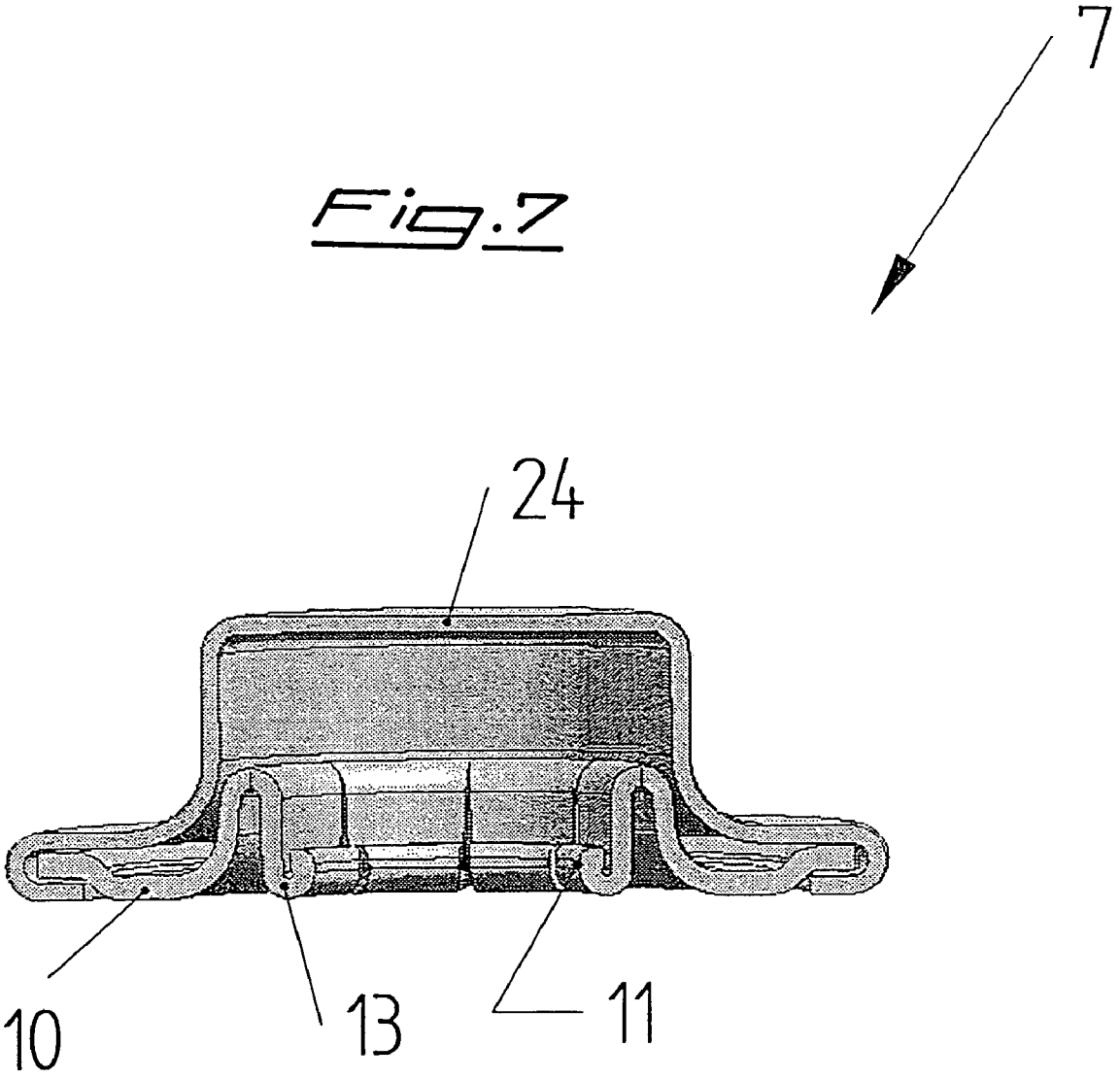
FIG. 7 illustrates a detail of the active female element used in both the modified embodiments shown in FIGS. 5 and 6.

In the modified embodiment shown in FIGS. 5 to 7, the active female element 7 of FIG. 7 differs from that shown in FIG. 4 owing to the provision of an unperforated bell element 24. In this case, the application of the female portion on the fabric flap 4 is performed by using either a clamping head 25 including a nail element 26 (FIG. 6) or a clamping head 27 including two points or pointed portions 28 (FIG. 5).

It should be apparent that, in all the disclosed embodiments the caps of the female element and male elements are arranged outside the fabric flaps and the female portion is not embedded in or covered by any fabric flaps.

The invention, as hereinabove disclosed and illustrated, is susceptible to several modifications to provide further modified embodiments which, however, will come within the scope of the following claims.

Figure 2:
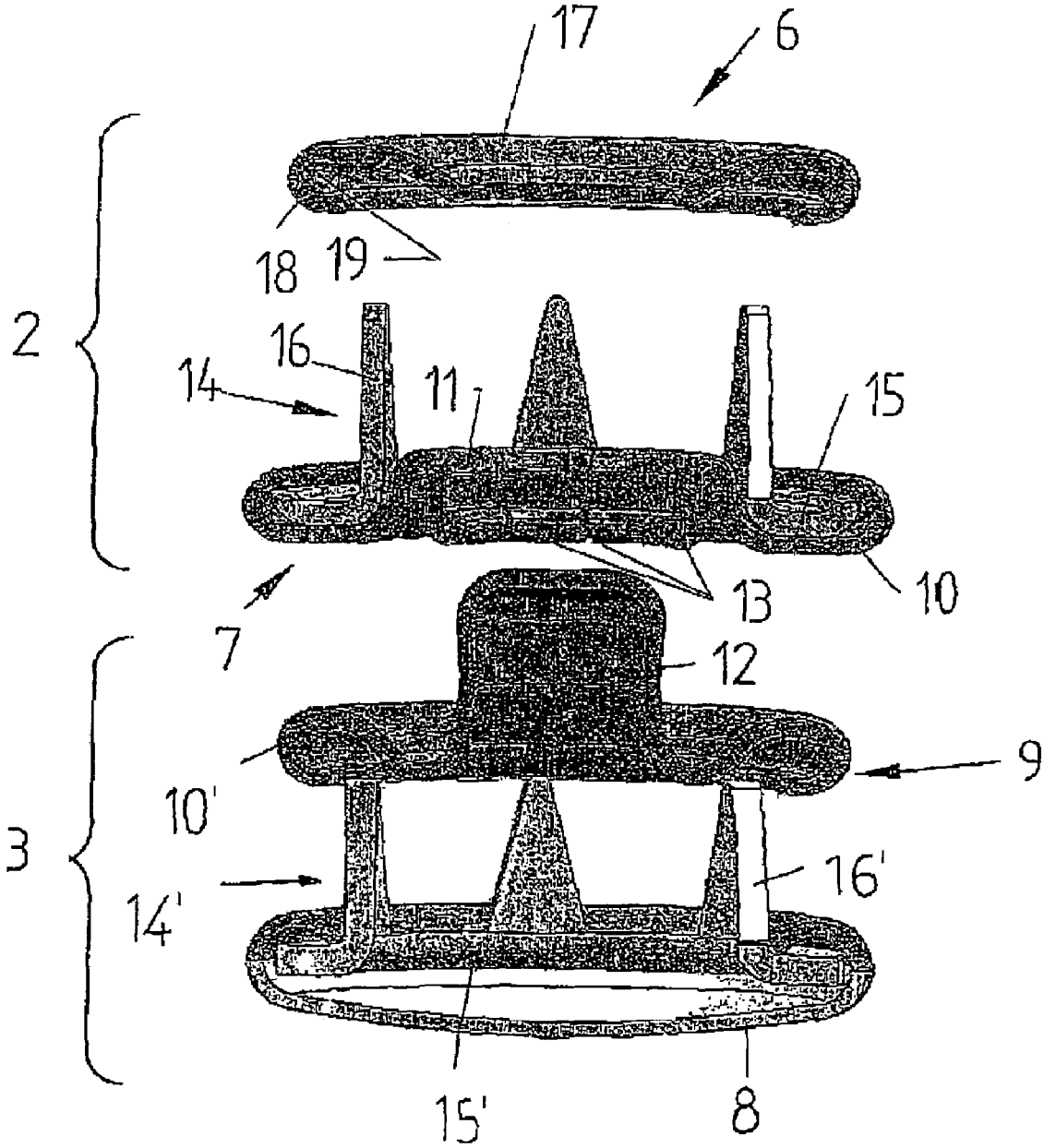
FIG. 2 is a perspective exploded view of the pressure button shown in FIG. 1.

Thus, for example, and as is shown in FIGS. 2 and 7, the edge of the annular body 10 can be folded about the respective clamping means (in FIG. 2 the clamp element 14) or can receive the upturned portion of the edge of the clamping means (the bell element 24 in the embodiment of FIG. 7), thereby mutually locking or clamping these parts.

The invention claimed is:

1. A pressure button, of a type comprising a female portion removably engageable with a male portion, said female portion being adapted to be fixedly coupled to a first fabric flap and said male portion being adapted to be fixedly coupled to a second fabric flap, said female portion having an active female element including a plurality of bottom resilient tabs arranged with a ring arrangement about a seat for housing an active male element of said male portion, a bell element clamped to said active female element, said bell element including an axial hole for engaging therein a stem of a clamping head cap of said active female element, said active male element comprising an annular body in which a gripping element is clamped, said gripping element comprising an annular bottom portion locked by bending within a male portion clamping cap and a plurality of projecting points formed integrally with said annular bottom portion of said gripping element, said clamping head cap and said male portion clamping cap projecting, with said female portion removably coupled to said male portion, from said first and second fabric flaps respectively.

2. A pressure button, of a type comprising a female portion removably engageable with a male portion, said female portion being adapted to be fixedly coupled to a first fabric flap and said male portion being adapted to be fixedly coupled to a second fabric flap, said female portion having an active female element including a plurality of resilient tabs arranged with a ring arrangement about a seat for housing an active male element of said male portion, a bell element, clamped to said active female element, said female portion being applied to said first fabric flap by a clamping head cap including a nail element, said active male element comprising an annular body in which a gripping element is clamped, said gripping element comprising an annular bottom portion locked by bending within a male portion clamping cap and a plurality of projecting points formed integrally with said annular bottom portion of said gripping element, said clamping head cap and said male portion clamping cap projecting, with said female portion removably coupled to said male portion, from said first and second fabric flaps respectively.

3. A pressure button, of a type comprising a female portion removably engageable with a male portion, said female portion being adapted to be fixedly coupled to a first fabric flap and said male portion being adapted to be fixedly coupled to a second fabric flap, said female portion having an active female element including a plurality of bottom resilient tabs arranged with a ring arrangement about a seat for housing an active male element of said male portion, a bell element clamped to said active female element, said female portion being applied to said first fabric flap by a clamping head cap including two pointed portions, said active male element comprising an annular body in which a gripping element is clamped, said gripping element comprising an annular bottom portion locked by bending within a male portion clamping cap and a plurality of projecting points formed integrally with said annular bottom portion of said gripping element, said clamping head cap and said male portion clamping cap projecting, with said female portion removably coupled to said male portion, from said first and second fabric flaps respectively.

* * * * *